US006128930A

United States Patent [19]

Schmidt

[11] Patent Number: 6,128,930

[45] Date of Patent: Oct. 10, 2000

[54] PROCESS AND CIRCULAR KNITTING MACHINE FOR MANUFACTURING A PATTERNED PILE FABRIC AND PILE ELEMENT THEREFOR

[75] Inventor: Walter Richard Schmidt, Krems, Austria

[73] Assignee: Adtec Services Limited, Tortola, Virgin Islands (Br.)

[21] Appl. No.: 09/142,610

[22] PCT Filed: Mar. 11, 1997

[86] PCT No.: PCT/EP97/01235

§ 371 Date: Nov. 12, 1998

§ 102(e) Date: Nov. 12, 1998

[87] PCT Pub. No.: WO97/34036

PCT Pub. Date: Sep. 18, 1997

[30] Foreign Application Priority Data

Mar. 12, 1996 [DE] Germany ..... 196 09 653

[51] Int. Cl.[7] ..... D04B 9/12

[52] U.S. Cl. ..... 66/92; 66/91

[58] Field of Search ..... 66/8, 9 R, 25, 66/40, 215, 91, 92, 93, 12

[56] References Cited

U.S. PATENT DOCUMENTS 4,592,212 6/1986 Schmidt .
5,463,882 11/1995 Yeh ..... 66/92
5,791,162 8/1998 Plath ..... 66/92

FOREIGN PATENT DOCUMENTS 082538A 6/1983 European Pat. Off. .
629727A 12/1994 European Pat. Off. .
2715170A 7/1995 France .
2038376 7/1980 United Kingdom ..... 66/92

*Primary Examiner*—Danny Worrell
*Attorney, Agent, or Firm*—Pillsbury Madison & Sutro LLP

[57] ABSTRACT

A patterned pile fabric with uncut and severed pile loops is manufactured on a circular knitting machine in which pile elements (1) are arranged in a cylinder (C) provided with an upper and a lower pile forming ledge divided by a holding hook. For the knitting and pile forming action the pile elements (1) are individually selected and actuated at least to two different positions in which one of the alternative pile forming ledges is arranged between the needles (N). Pile loops drawn out over the upper pile forming ledges are cleared from the pile elements in the subsequent feeder by an additional clearing movement while pile loops formed over the lower pile ledge will remain on the pile elements. Those pile loops will slide downwardly along the stems of the pile elements by the subsequent knitting. In a continuation of the lower pile forming ledge the stems of the pile elements are provided with a cutting edge (1C) that will cooperate with a cutting edge (2C) of cutting elements (2) so that all pile loops coming to this continuation section are severed by a cutting movement of the cutting elements.

22 Claims, 6 Drawing Sheets

PROCESS AND CIRCULAR KNITTING MACHINE FOR MANUFACTURING A PATTERNED PILE FABRIC AND PILE ELEMENT THEREFOR

BACKGROUND OF THE INVENTION

1. Field of the Invention

The present invention relates to a knitting process, employing a circular knitting machine and pile elements, for manufacturing a patterned pile fabric having different pile structures in which the pile loops can be either severed or remain uncut.

2. Description of Related Art

Pile fabrics in which a loop structure individually alternates with velour, i.e. a severed pile construction, can be produced by different methods.

In one of these methods, after knitting a plain loop fabric, the shearing machine used in a subsequent finishing process is equipped with a patterning device which, in part, avoids severing all of the pile loops. This method is limited by the requirements of the patterning device and by a single shearing action which reduces the reliability of this method.

Therefore, prior to the present invention, it has been common to knit pile fabrics having different pile lengths and to subsequently finish the longer pile loops to a velour structure by one or more shearing actions. It is obvious that the knitting as well as the finishing or shearing processes require an extraordinarily precise adjustment in order to obtain perfect velour surfaces while at the same time leaving the shorter pile loops uncut.

For knitting pile fabrics having both shorter and longer pile loops, pile elements, preferably sinkers, are provided with two different pile forming ledges and are selectively actuated between the needles by one of these ledges. Such proposals are referred to e.g. in DE-PS 656 588, U.S. Pat. No. 3,477,255 or EP-A1-0 629 727 A1.

Alternatively, forming pile loops at different lengths excludes an equalizing work step, such as stretching out, straightening and holding the pile loop during the knitting cycle of a succeeding course, at least in the succeeding feeder, for example, according to the teaching of U.S. Pat. No. 4,020,653, and is today with different variations, part of modern pile knitting methods used to avoid pile and stitch deformations leading to defects such as uncut pile loops in a velour fabric. This drawback in knitting a two-level pile fabric, and the restriction in the adjustment of the shearing machine to sever exclusively longer knitted loops, inevitably results in some defects in the velour parts of such fabrics which must be accepted.

In the past, numerous proposals for severing pile loops in the knitting machine have already been made as referred to in the introductory portion of EP-A2 0 082 538, which is incorporated herein by reference. Using this proposal, and the presence of sufficiently dimensioned pile and cutting elements that cooperate in a scissor-like arrangement, results in a satisfactory reliability in the step of severing the pile loops and in acceptable intervals for replacing worn pile and cutting elements.

The proposed methods for severing predetermined pile loops, as reported in DE-OS 1 585 051 and DE-OS 29 17 378, apparently have not been implemented under practical conditions. In these proposals it is pointed out that formation of uncut and severed pile loops, in the same course, is limited to a predetermined application of the pile elements and the adjustment of corresponding cams. Additionally, in the German patent application 1 585 051 it is noted that special fabric constructions must be knitted, for which reason the gauge of the dial is only half the gauge of the cylinder. This knitting process suffers from the disadvantage that the pile loops are cleared immediately subsequent to the stitch and pile forming process, possibly resulting in stitch and loop deformations. The clearing movement for uncut pile loops, which is identical with the severing action, is not sufficient for accurately clearing these loops when pile loops are formed by adjacent needles.

SUMMARY OF THE INVENTION

With the foregoing in mind, it is the main object to the present invention to provide a method for knitting a pile fabric patterned by individually predetermined severed and uncut pile loops without limitations. Another object of the invention is to achieve the possibility of knitting the pile loops which are to remain uncut at a shorter length than those which are to be severed, and to furthermore obtain a satisfactory pile and loop structure in the fabric.

Starting out from the method described in DE-OS 1 585 051, the present invention relates to a method for producing a patterned pile fabric comprising severed as well as uncut pile loops in one course of stitches on a circular knitting machine which includes latch needles and pile elements arranged at a right angle between the latch needles for forming pile loops. The pile elements include two different pile forming ledges, arranged adjacent one another in the longitudinal direction of the pile element, for forming pile loops which are to be severed and pile loops which are to remain uncut and which are drawn out to different lengths, in accordance with a pattern, such that the pile thread is fed to one of the two pile forming ledges. Also, the pile forming ledge for forming the pile loops which are to remain uncut, form the termination on the head side of the pile element and the pile loops which are to remain uncut are cleared prior to the subsequent pile forming step by the pile element being retracted. According to the present invention it is further provided that the cutting zone is arranged at such a distance from the pile forming ledge, for forming pile loops to be severed, that the pile loops to be severed will enter the cutting zone only after at least one more course of stitches are produced, and that the selection for controlling the pile elements in pile formation is also used in controlling the pile elements with respect to their subsequent retracting motion.

In order to attain such objectives, recourse is thus initially had to the fundamental teaching of EP-A2 0 082 538, and the process of forming the pile loops that is separated both spatially and in time from the actual cutting process. This not only permits application of a reliable cutting technology, such as one improved in accordance with the teaching of the prior German patent application No. 195 18 490.4, but it also ensures that the pile loops to be severed are only severed once they have been consolidated in the fabric.

Due to the fact that the selective control over the pile elements is also used for controlling the subsequent retracting motion of the pile elements is the pile elements can be actuated to a greater extent during pile formation, on which pile loops to be severed are formed, and to also have a higher position during the retracting motion, i.e., they are retracted for a smaller distance, resulting in the pile loop remaining on the pile forming ledge. On the other hand, the pile elements that are actuated to a shorter extent, on which pile loops are formed that will remain uncut, are retracted to a lower position, such that upon each retracting motion the formed pile loop is securely cleared and the pile forming ledge in question is again available for a pile forming position in the following feeder. While the length of pile loops may thus be preselected through pile element geometry, secure mounting of the pile loops that are to be severed on the related pile forming ledge, and secure clearing of the pile loops that are to remain uncut, are ensured by the different retracting positions of the pile elements, with the possibility of selecting the respective positions of the retracted pile elements in accordance with the formed pile loops.

In terms of device technology, the invention starts out from a circular knitting machine, also described in DE-OS 1 585 051, for producing a patterned pile fabric comprising severed and uncut pile loops in one course of stitches. The knitting machine includes latch needles and pile elements arranged at a right angle between the latch needles for pile formation, with the pile elements comprising two different pile forming ledges, arranged adjacently in the longitudinal direction of the pile element, for forming pile loops to be severed and pile loops to remain uncut. The pile forming ledge for forming the pile loops to remain uncut forms the termination of the pile element on the head side. The knitting machine also includes a selecting mechanism for differently actuating pile elements in accordance with a pattern and also for retracting the pile elements. The object is attained in that the selecting mechanism is also provided for selecting the pile elements for the retracting motion, and that on the one side of the pile forming ledge intended for pile loops to be severed, located opposite the pile forming ledge for pile loops to remain uncut, a cutting zone follows.

Tensioning or stretching of the pile loops, in order to ensure their reliable consolidation into the stitches, may be effected by both pile forming ledges being terminated at the ends on their head side by tensioning ledges or stretching ledges, respectively.

In a particularly preferred manner the stretching ledge, terminating the pile forming ledge for pile loops that are to remain uncut, is arranged at an inclination directed towards the head side, with respect to the longitudinal axis of the pile element, wherein the inclination angle should be in the range of 20° to 70°, and preferably 30° to 60°. Thereby, in the course of the retracting motion, tensioning of the pile loops which are to remain uncut may be effected, as well as their subsequent clearing in the area of the lowest retracting position when the pile loop leaves the tensioning ledge for being cleared, preferably while sliding over a guiding tip.

It is particularly preferred that if, in contrast with the teaching of DE-OS 1 585 051, the latch needles are arranged in the dial and the pile elements are arranged in the cylinder, and that the inner back of each pile element is formed to project towards the dial in the area located opposite the pile forming ledge for pile loops that are to remain uncut while forming a retaining means for the course of stitches formed last. In this manner the pile elements may be advanced towards the dial as closely as is possible in view of reliable ground thread feeding while simultaneously forming a channel sufficient for unimpeded ground thread feeding and latch closing movement underneath the projecting back of the pile elements. Owing to the lowering ledge thus formed in downward orientation and the impossibility of the fabric escaping in an upward direction, the course of stitches knitted last is securely held without additional elements being required for this purpose.

The pile elements for a circular knitting machine in accordance with the invention are active independently of each other and comprise particular features in accordance with the invention. For instance, they differ from the pile element of DE-OS 1 585 051 by comprising two different pile forming ledges arranged adjacently in the longitudinal direction of the pile element, and with both pile forming ledges being terminated at their ends on the head side by tensioning or stretching ledges, respectively. This ensures the stretching of pile loops to be severed and the tensioning of pile loops that are to remain uncut and thus assures their secure consolidation in the stitch.

Due to the fact that the stretching ledge terminating the pile forming ledge on the head side is arranged at an inclination directed towards the head side with respect to the longitudinal axis of the pile element, with the angle being in the range of 20° to 70°, and preferably 30° to 60°, tensioning as well as clearing of the formed pile loop which is to remain uncut is ensured in the range of the lowest retracting position.

Due to the fact that a projection is formed on the back of the pile element opposite the pile forming ledge on the head side, a retaining means for the course of stitches knitted last may be realized without additional expense.

Precise control over the course of stitches knit last on the one hand and of the fabric, possibly including pile loops which are to be severed but not yet cut, results if the projecting back of the pile element forms a retaining and lowering ledge having an inclined arrangement with respect to the longitudinal direction of the pile element deflecting from the dial and shaping a throat on the lower end.

When implementing the method of the present invention on a circular knitting machine according to the invention, at least a portion of the pile elements are actuated with one of their pile ledges being positioned between the needles prior to the stitch and pile forming process involving one ground and pile thread each. Simultaneously with the subsequent needle movement the pile loops are controlled by the pile elements. Each pile forming ledge of the pile elements stretches out the pile loops after the stitches have been cleared from the needle latches by a retracting movement. An additional retraction of those pile elements causes those loops previously formed and which are to remain uncut to be cleared by the pile elements. The pile elements previously actuated to form uncut pile loops will clear the last pile loops from the pile forming ledges by an additional movement without overstretching or deforming those pile loops knitted before and selected to be severed in one of the succeeding severing actions. Subsequent to the stretching and clearing of the pile loops, the needles are actuated to the feeding position and the pile elements are moved to the severing position.

The pile elements are provided with a sharp cutting edge which is a continuation of the pile forming ledge below a holding hook that prevents pile loops from clearing during the pile stretching action. For severing pile loops, cutting edges of the cutting elements are positioned opposite the cutting edges of the pile elements which are in permanent contact with these. Simultaneously with the severing action the selection for the subsequent course is performed and thereafter the pile elements are again actuated to their predetermined positions for pile forming in accordance with a desired pattern.

Other objects, features, and characteristics of the invention will become apparent upon consideration of the following description and the appended claims with reference to the accompany drawings, all of which form a part of this specification.

BRIEF DESCRIPTION OF THE DRAWINGS

The invention shall be explained in more detail by means of an embodiment while making reference to the enclosed schematic drawings, wherein.

DETAILED DESCRIPTION OF A PREFERRED EMBODIMENT

Figures 1, 2:
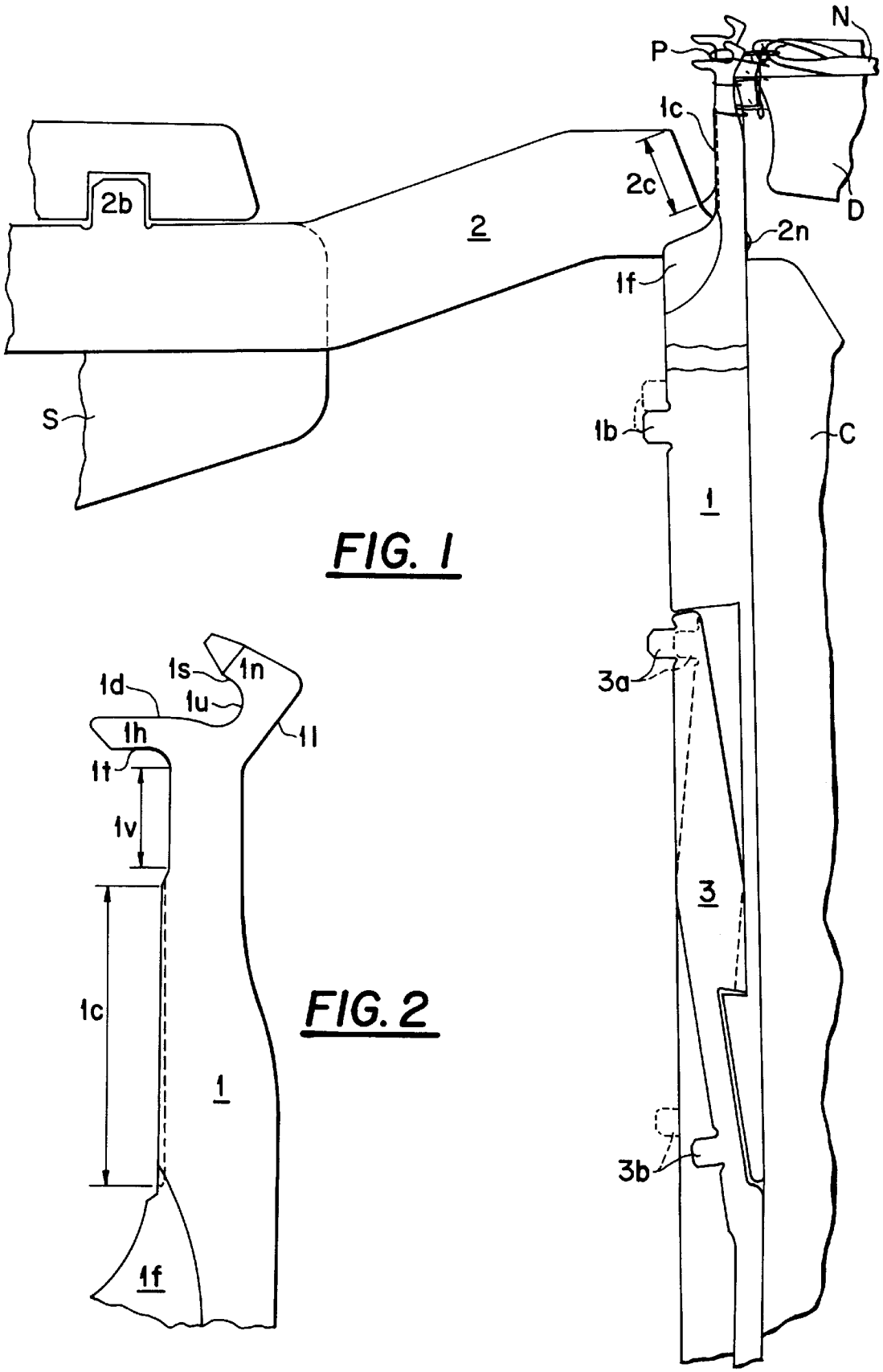
FIG. 1 is a simplified schematic cross-section of a cut pile machine.
FIG. 2 is an enlarged part of the pile element showing the pile forming and severing ledges.

The cut pile machine shown in the simplified cross-sectional view of FIG. 1 is fundamentally known from the proposal made in EP-A2-0 082 538 (corresponding to U.S. Pat. No. 4,592,212 and JP-PS 1 457 562) which is herewith fully incorporated by way of reference for further details. The ground fabric is knit by the reciprocating movement of latch needles N arranged in a dial D, which movement is controlled by a dial cam system known per se so that further description thereof is not required for one skilled in the knitting arts. In accordance with the predetermined fabric structure one (plain fabric) or more (structured ground fabric) types of needles are used. In the present embodiment, a plain ground fabric is knit on the knitting ledge Dk of the dial D, referenced in FIGS. 3 and 7, by using uniform needles.

A pile yarn P is drawn out into pile loops alternatively over pile forming ledges 1*v* or 1*u* of pile elements 1, shown in FIG. 2, simultaneously with the stitch forming action. The pile element 1, arranged in a cylinder C, shown in FIG. 1, are individually controlled by jacks 3 designed as double-arm levers comprising upper and lower butts 3*a* and 3*b*, respectively, on each lever arm. Jacks 3 are mounted in a recessed portion of the pile element 1 and are pivoted by selectors which are actuated by mechanical or electronic means. By this arrangement or by another adequate system, the pile elements 1 must be at least forcibly controllable in their retracting movement. In their dividing position (shown in FIG. 1 in full lines) a jack 3 is pivoted with its upper butt 3*a* protruding from the cylinder C and with its lower butt 3*b* being depressed into the cylinder slot, so that alternatively one of the butts 3*a* or 3*b* can be actuated by cooperating cams depending on the position of the jack 3. Referring to FIG. 1, cams (not shown) acting on butt 3*a* have raised the pile element 1 shown in front of FIG. 1 with the upper pile forming ledge lu between the needles while protruding lower butts 3*b*, actuated by corresponding cams (not shown), will raise their respective pile elements 1 with their lower pile forming ledge 1*v* between the needles as shown from the pile element 1 behind the needle (and from butt 1*b* and 3*b* in dashed lines).

It should be noted that patterning controls corresponding to the above description are known, for example, from the documents DE-OS 23 64 128 or DE-OS 24 47 427.

The pile elements 1 are controllable by a butt 1*b* for uniform positioning including placement at a severing position.

Figure 4:
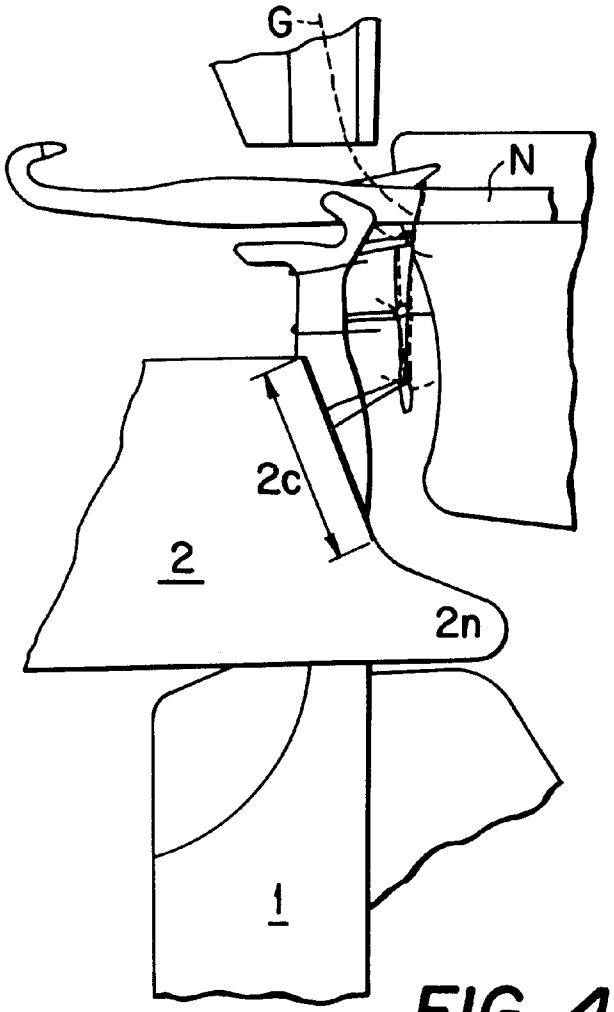

Referring to FIG. 2, each pile element 1 is provided with an upper pile forming ledge 1*u* and a lower pile forming ledge 1*v* which are separated by a dividing hook 1*h* having a lower tensioning ledge 1*t* and an upper dividing ledge 1*d*. The upper pile forming ledge 1*u* is elongated by a stretching ledge 1*s* on an angled nib in which also has an inclined lowering and retaining ledge 1*l*. In continuation of the pile forming ledge 1*v*, the stem of the pile element 1 is shaped to a cutting edge 1*c* which cooperates with an angled cutting edge 2*c* of cutting elements 2, as shown in FIGS. 1 and 4.

As shown in FIG. 1, cutting elements 2 are arranged in a sinker ring S which is attached on the cylinder or positioned externally thereof and driven synchronously with the cylinder C (like the dial). The reciprocating movement of the cutting elements 2 is performed by cams acting on the butts 2*b*.

The preferred cutting conditions in which the cutting edges 2*c* cooperate with the cutting edges 1*c* of the pile elements 1 are described with reference to FIGS. 2 and 3 of the earlier referenced German patent application 195 18 490.4. This prior patent application is incorporated by way of reference in order to avoid repetition with respect to such details. To perform the cutting action the cutting elements 2 are arranged at an inclination creating a pressurized contact angle, in the lateral contact with the pile elements 1. The cutting edges 1*c* and 2*c* are therefore disposed opposite on the contacting flanks of their elements 1 and 2, and cutting edge 2*c* is also inclined with respect to the longitudinal extension of cutting edge 1*c* thereby defining a cutting angle. Both edges 1*c* and 2*c* additionally diverge in an upward direction from each other to shape an open throat and an opening angle into which pile loops slide by subsequent knitting operations. Preferably, the permanent contact of both parts between the cutting actions is obtained at least through the nib 2*n* of the cutting elements.

The lateral pressure of the cutting element 2 against the pile element 1, required for the cutting action, produce a resilient bending contact of the cutting element 2 whereby the portion of cutting element 2 overlapping the pile element 1 towards to the machine, subsequent to the contact point, is deflecting from the pile element 1 laterally. This deflection is intensified due to the inclined arrangement of cutting edge 2*c* with respect to the cutting edge 1*c* during the cutting action, with the point of mutual contact between the two cutting edges being dispositioned from below in the upward direction. Consequently, a perfect scissor-like severing of the pile loops slided on the cutting edges 1*c* is performed by closing the previously shaped V-like throat by cutting ledge 2*c*.

Figure 3:
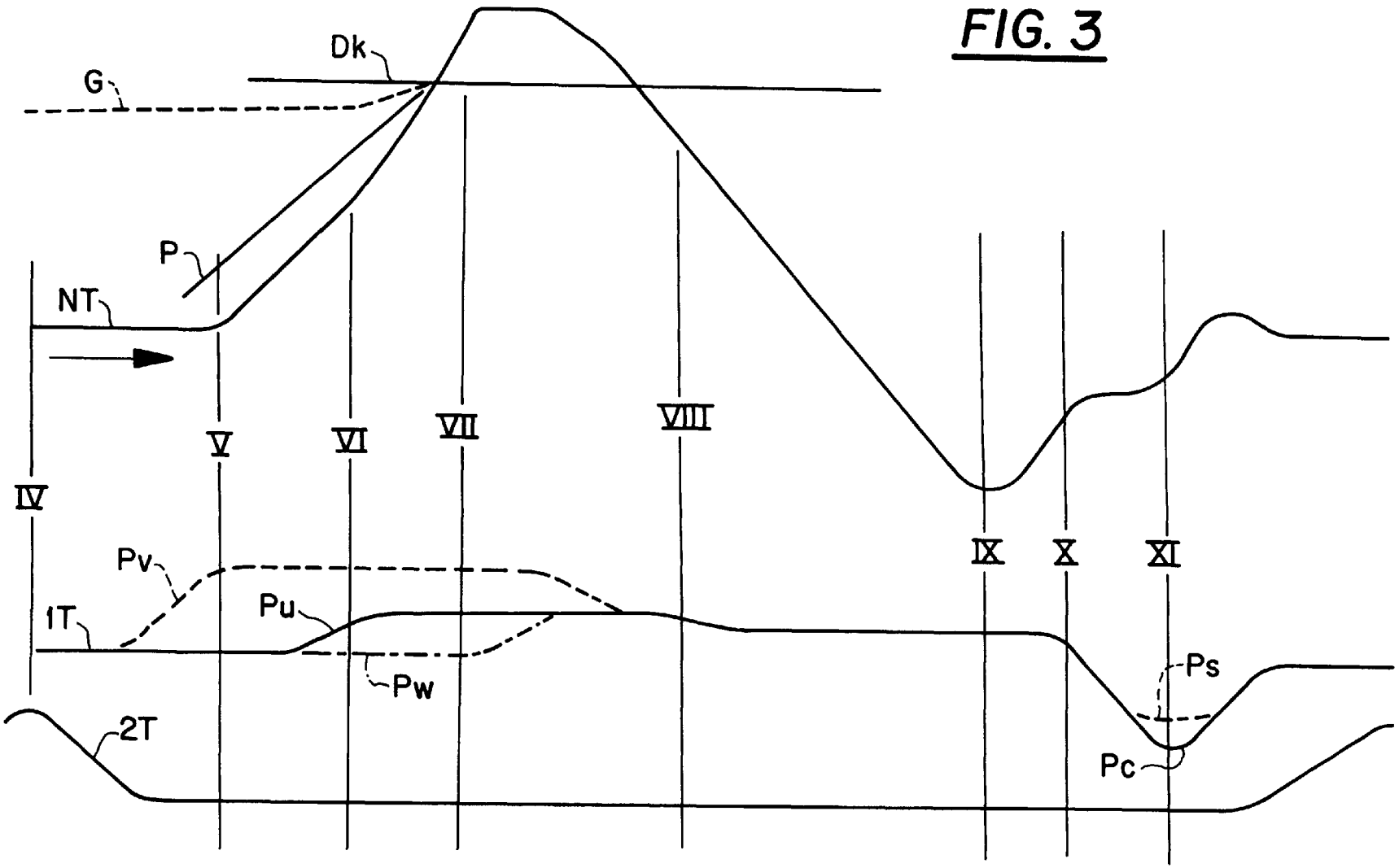
FIG. 3 is a diagram showing the tracks of needles pile and cutting elements in relation to each other.

FIG. 3 illustrates the required movement of the needles, as well as the pile and cutting elements in relation with each other for knitting a complete plain pile course. The needles N pass along track NT. The track of the cutting elements is indicated at 2T, while the pile elements pass along alternative tracks 1T, Pv (or Pu, Pw), Pc and Ps depending on the predetermined loop formation. The knitting cycle is performed from the left to the right as indicated by the arrow and essential sections marked IV to XI, are shown in FIGS. 4 to 11, respectively.

In FIG. 4 the cutting element 2 was moved to the innermost position. The cutting edge 2*c* has passed inwardly beyond the cutting edge 1*c* to perform a perfect scissor-like cutting of those pile loops that had previously slid between them. Simultaneously to the movement of the cutting elements 2 the needles N were retracted to the feeding position for feeding a ground yard G to them. Furthermore, the pattern mechanism has rearranged the jacks 3 so that a selected portion of the cooperating pile elements 1 can be fully raised by butt 3*b* as in FIG. 1, in accordance with track Pv in FIG. 3, whereby their pile forming ledges 1*v* are raising between the needles, immediately prior to the end of the retracting movement of the cutting elements.

Figure 5:
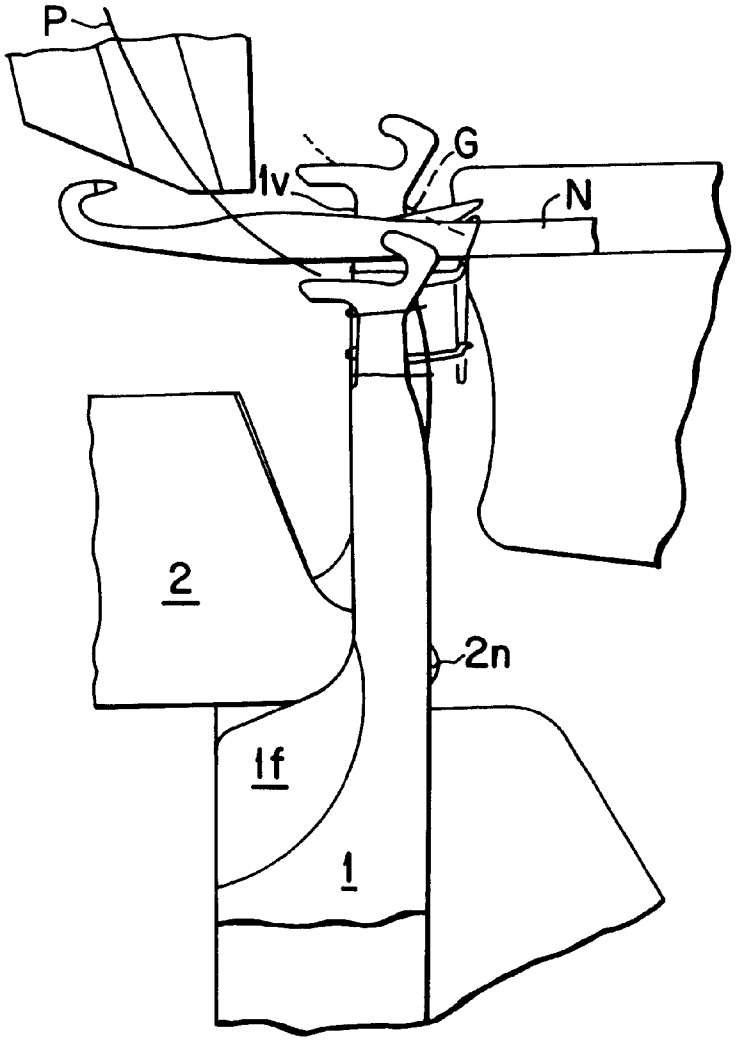
FIGS. 4 to 11 show the cooperation of needles, pile and cutting elements in the positions indicted by IV to XI in FIG. 3.

This disposition is indicated in FIG. 3 with V and shown in FIG. 5. The ground yarn G is arranged at the backs of the raised selected pile elements 1 while the other pile elements 1 remain in an idle position. After the feeding of a pile yarn P in front of the raised pile elements 1, the needles N start to retract inwardly. Simultaneously a cam acting on butt 3*a* (FIG. 1) raises all or selected pile elements 1 (if an additional dividing action of the pattern mechanism is provided) to an intermediate position as indicated by the track Pu and shown in FIG. 3 to engage the pile yarn P with the pile forming ledges 1*u* as shown in FIG. 6.

Figure 7:
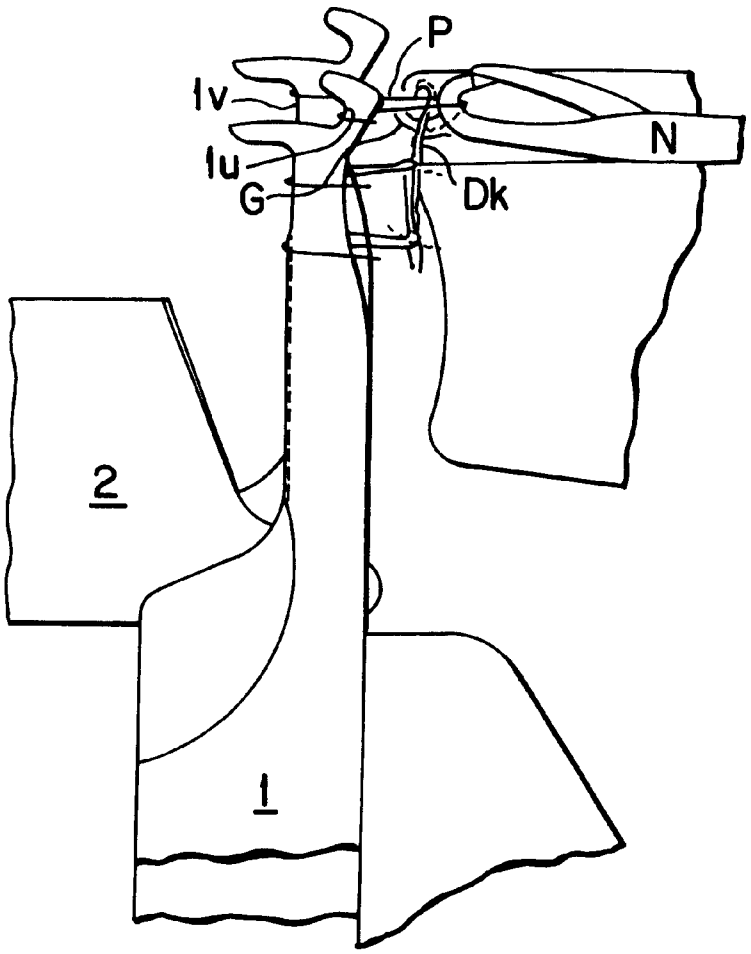

In FIG. 7 all the needles N are finally retracted to the cast-off position whereby a plain course of stitches is knitted. The ground yarn G is positioned by the inclined knitting ledge Dk of the dial on the inside of the needle hook, while the pile yarn P, not affected by the dial, is located in the uppermost arc position of the needle hook to perform a perfect regular plating relationship of the ground yarn to the pile yarn.

As shown in FIG. 7, the pile forming ledges 1*u* and 1*v* are arranged in a different space from the dial D thereby forming pile loops of different lengths. The pile loops Lu determined to remain uncut should be shorter than those to be severed in order not to be affected in a subsequent equalizing shearing process for the severed loops. A sufficient difference in the length, such as about more than 0.3 mm, of the different alternative pile loops provides an additional patterning effect.

Figure 6:
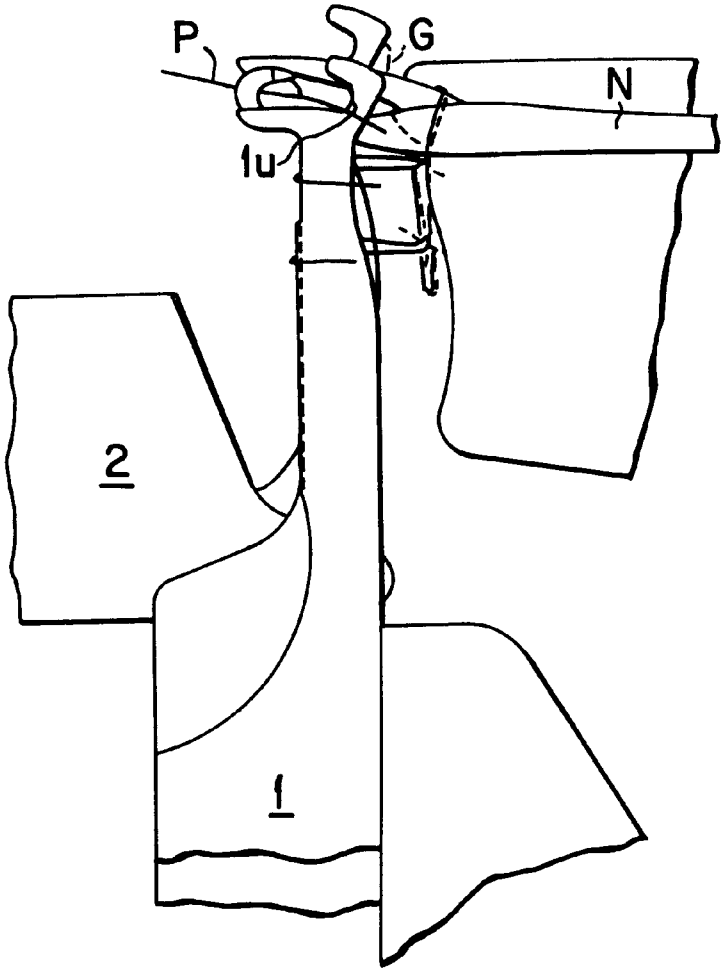

Again referring to the description of FIG. 6, and of the cam actuating selected pile elements 1 to an intermediate position for uncut pile loops, it should be noted that pattern effects resulting from alternating severed pile loops and uncut pile loops together with plated ground fabric (without loops) are obtained by two dividing actions per feeder. In the case of only one dividing action a simple change from a pattern with the alternative pile loops to a pattern with severed (or uncut) pile loops in combination with plated ground fabric is possible by resetting the respective cams. Portions of plated ground fabric are obtained when pile elements are actuated according to track Pw in FIG. 3.

Figure 8:
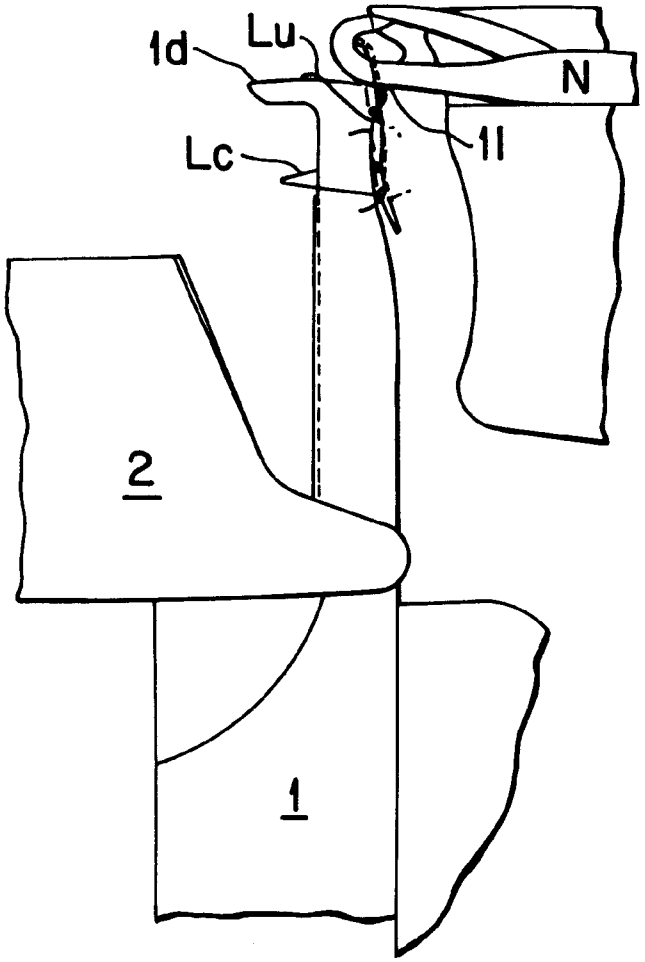

Subsequent to the stitch and pile forming process, the needles N are raised outwardly from the dial. As shown in FIG. 8, all of the pile elements are simultaneously arranged between respective needles N. By the frictional contact of the stitches on the raising needles the fabric is also moving from the dial outwards, so that the sinker loops of the fabric, knitted from ground yarn G, will contact the downwardly inclined lowering ledge 1*l* on pile elements 1 so that the lowering ledges 1*l* will prevent the fabric from a further movement with the needles and will support the take down action. The disposition of the fabric will also loosen the contact of the pile loops on the pile-forming ledges. For this reason the dividing ledge 1*d* of the dividing hook 1*h* must be sufficiently dimensioned to control pile loops Lu to the subsequent clearing separate from the pile loops Lc which were drawn out by the pile-forming ledges 1*v* and remain on the pile forming ledge of the pile element 1 in an as yet uncut condition, until they are disposed on the cutting edges 1*c*.

Figure 9:
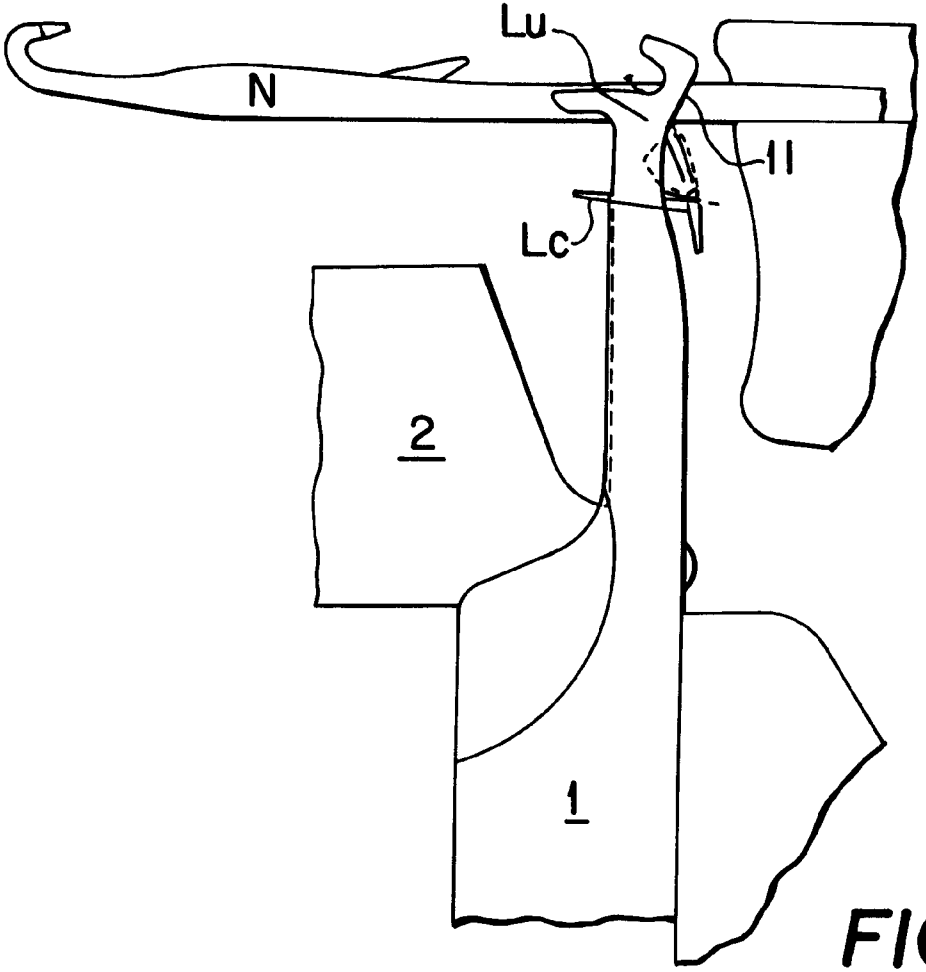

The pile elements 1 remain in this position until the needles N are completely raised and the stitches are cleared from the latches of the needles as shown in FIG. 9. As is generally known, the stitch-portions from the pile yarn may in the process be enlarged by the needle movement to such an extent that defects in the fabric may occur in the absence of precautions.

Figure 10:
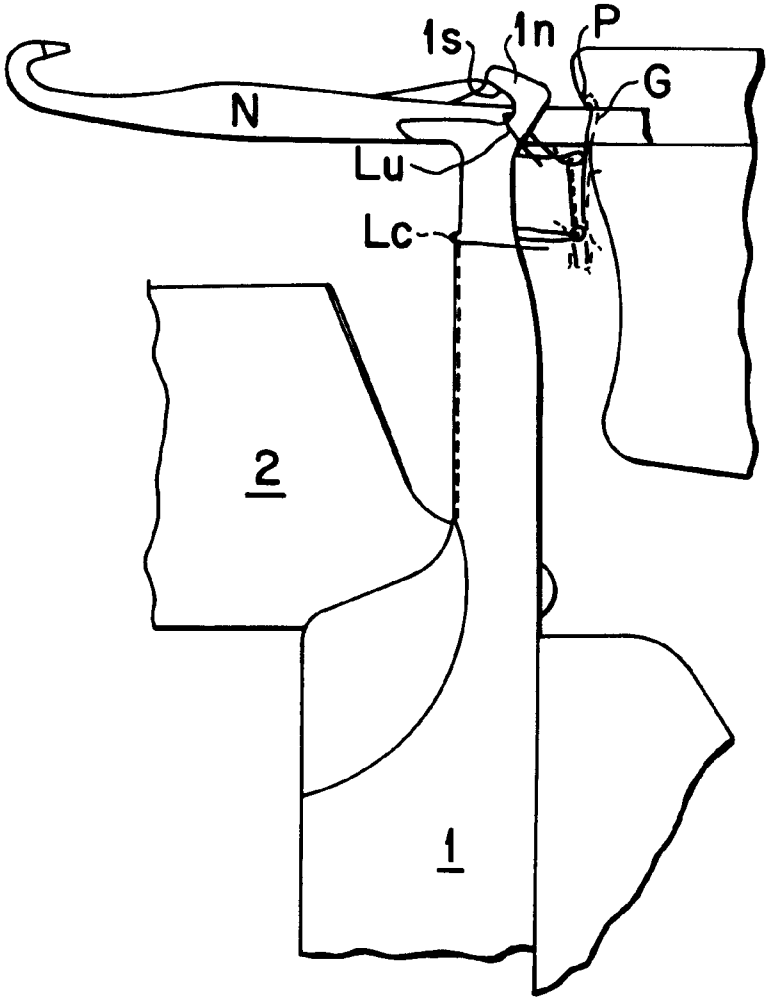

Therefore, in accordance with FIG. 10, the needles N are initially only retracted after clearing slightly so that thereby the stitches are frictionally positioned on the dial and the pile loops on the corresponding pile forming ledges.

Figure 11:
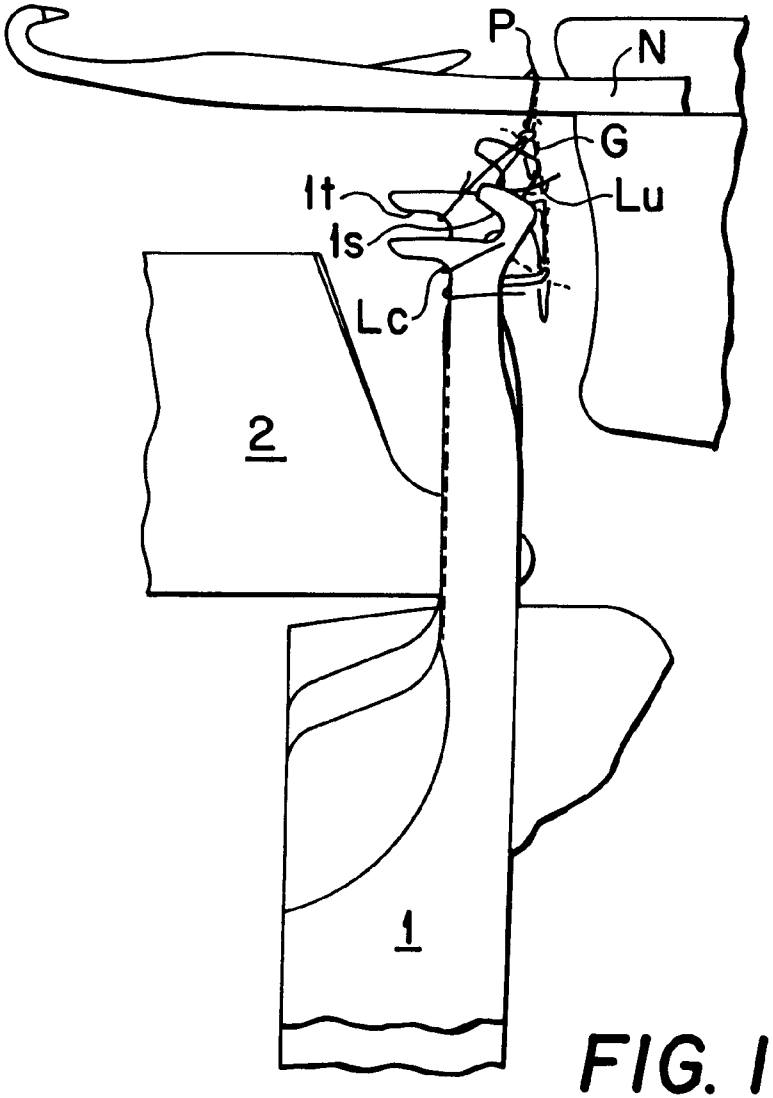

Thereafter the pile elements 1 are retracted as shown in FIG. 11 so that the pile loops Lu, drawn out by the pile-forming ledges 1*u*, are engaged by the stretching ledges 1*s*, respectively by the tensioning ledge 1*t* when formed over the pile-forming ledge 1*v*, and will be stretched out so that connecting enlarged stitch portions from the pile yarn P are retracted and tightened around the needle stems.

As shown in FIG. 11, tensioning of the pile loops Lu and Lc formed by the pile forming ledge 1*v* and 1*u* is easily performed by ledges 1*t* and 1*s*. The pile loops Lu must, moreover, be cleared from their pile elements to remain uncut in the same movement.

The general retracting movement of the pile elements 1 is limited in order to avoid overtensioning and deformation of the previous knitted pile loops Lc whereby the perfect clearing of pile loops Lu from the pile elements is diminished. Reliable obtention of this required supposition is achieved by selective retracting movements performed by one of the butts 3*a* or 3*b* of the cooperating pattern jacks 3. For this reason the selection control of the previous pile forming process must be maintained so that the pile elements which were actuated into an intermediate position for forming uncut pile loops Lu in the knitting action (FIG. 7) will be retracted in accordance with track Pc in FIG. 3 to a lower position than the other pile elements which will pass along track Ps. The retracting movement of the pile elements 1 for clearing uncut pile loops Lu is herein restricted by the pile loops Lc of the previous course which will be severed in a succeeding cutting operation.

After clearing the pile loops Lu formed by ledges 1*u*, the needles N are then retracted inwardly to a feeding position and the stitches of the previous course are again disposed on the knitting ledge Dk of the dial. This may be supported by mechanical or pneumatic means to position the cleared pile loops Lu securely behind the nibs ln and on the backs of pile elements 1 when they are raised to the cutting position whereupon the cutting elements 2 perform their inward movement. With this movement the process according to the invention is completed and is performed again as described above.

The described preferred embodiment can be modified in different variations particularly in accordance with the features of the selecting mechanism. Contrary to the described embodiment, after clearing the pile loops Lu (as shown in FIG. 11), the pile elements 1 may immediately be raised to the full extent, and subsequent to the cutting action, predetermined pile elements 1 may be retracted into an intermediate position according to track Pu of FIG. 3 or additionally retracted into an idle position. This procedure creates knitting conditions comparable with those of the above described embodiment and requires only a forcible retraction of the pile elements 1 by the jacks 3. This demonstrates the large variety of modifications provided in implementation of the present invention.

When the pile elements 1 are precisely controlled by the jacks 3 in their longitudinal movements, as described in accordance with FIG. 1, it is also possible to retract the selected and fully raised pile elements simultaneously with the knitting action, whereby the pile length of the pile loops Lc to be severed, is adjustable to the pile length of the uncut pile loops Lu.

In the mentioned movement of pile elements 1 the pile yarn is positioned by ledges 1*t* to the inside of the needle hooks and performs a reverse plating of the pile yarn. This is also realized for uncut pile loops Lu with an adequate position of nibs in with their ledges is when loops to remain uncut are drawn out.

It should be understood that in addition to the preceding description, the ground fabric construction may, of course, be varied according to numerous known specifications.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method for manufacturing a patterned pile fabric having severed as well as uncut pile loops in one course of stitches on a circular knitting machine, the machine having latch needles (N) and pile elements (1) arranged at a right angle between said latch needles for forming pile loops, as well as cutting elements (2) cooperating with cutting ledges (1*c*) of said pile elements (1)

arranging pile elements (1) in a cylinder C and individually controlling the arranged pile elements by controlling a plurality of pattern jacks (3) designed as double arm levers having upper and lower butts (3*a* and 3*b*), arranging two pile forming ledges (1*u*, 1*v*) to positions adjacent said pile element in a longitudinal direction for forming pile loops (Lc) to be severed and pile loops (Lu) to remain uncut in accordance with a pattern, feeding a pile thread (P) to one of said two pile forming ledges (1*u*, 1*v*), and forming pile loops (Lu) that are to remain uncut over pile forming ledges (1*u*) and clearing uncut pile loops (Lu) prior to the subsequent pile forming step by retracting the pile elements (1), said method including the further steps of maintaining the selected pile forming positions of the actuated pile elements (1) thereby controlling the pile elements (1) with respect to their subsequent retracting motion when the pile loops are cleared from the needle latches, and arranging the cutting ledges (1*c*) at such a spacing below the latch needles (N) such that said pile loops (Lc) to be severed will slide onto said cutting ledge (1*c*) only after knitting at least one more course of stitches.

2. A method according to claim 1, further including the steps of a) arranging selected pattern jacks (3), for controlling the associated pile elements (1), in two different positions for the pile forming process, and holding such selected pattern jacks (3) concurrently with raising needles (N) to a clearing position, b) positioning pile elements (1) having downwardly inclined lowering ledges 1*l*) between the needles (N) for engaging the fabric on sinker loops of a previously knitted course on said lowering ledges (1*l*) and thereby supporting the take down of the fabric and preventing movement of the fabric with the raising of needles (N)

c) retracting the pile elements (1), after clearing stitches from the latches of the needles (N) according to the disposition of the pattern jacks (3) to a tensioning position, d) retracting the pile elements (1), previously raised for forming uncut pile loops (Lu), to an extent such that subsequent to the stretching out of the pile loops (Lu) those pile loops (Lu) are cleared over nibs (1*n*) from the pile elements (1), and e) subsequently, raising the pile elements (1) into a cutting position in which at least the pile loops (Lc) of the previous course are arranged above the cooperating cutting ledges (1*c*, 2*c*) of the pile elements (1) and the cutting elements (2) and operating the cutting elements (2) to cut concurrently with the resetting and re-selecting of the pattern jacks (3) and with the retracting of the needles (N) to a feeding position for knitting the succeeding course.

3. A method according to claim 1, wherein selected pile elements (1) remain in a cutting position when the pile forming process is performed so that such pile elements (1) are excluded from pile forming.

4. A method according to claim 1, wherein the pile loops (Lu) remaining uncut and the pile loops (Lc) determined to be severed are drawn out to different lengths.

5. A method according to claim 4, wherein the pile loops (Lu) remaining uncut are drawn out to a shorter length than those pile loops (Lc) determined to be severed.

6. A method according to claim 1, including the step of holding the pile elements (1) with their pile forming ledges (1*u*, 1*v*) in the selected positions in the stitch and pile forming action of the needles so as to position the pile yarn (P) in a correct plating relationship relative to the ground yarn (G).

7. A method according to claim 1, including the step of retracting the pile elements (1) according to their selected positions concurrently with the stitch and pile forming process thereby positioning the pile yarn (P) in a reverse plating relationship relative to the ground yarn (G).

8. A method according to claim 7, including the step of selecting pile elements (1) to engage the pile yarn (P) with their pile forming ledge (1*v*) for forming loops (Lc) to be severed and retracting such selected pile elements (1) concurrently with the stitch and pile forming process to an extent that the pile loops (Lc) are drawn out by the tensioning ledge (1*t*) of the dividing hook (1*h*) so that the lengths of the pile loops (Lc) to be severed and the difference in length between the pile loops (Lc) to be severed and the pile loops (Lu) remaining uncut are adjustable.

9. A circular knitting machine for producing a patterned pile fabric comprising severed as well as uncut pile loops in one course of stitches, comprising a dial reciprocatingly supporting a plurality of movable latch needles (N) for knitting a ground fabric;

a cylinder in which pile elements (1) are arranged at a right angle to said needles (N) said pile elements being reciprocatingly movable relative to and between said needles (N), said pile elements being operatively connected with associated pattern jacks (3) for controlling at least the retraction of the pile elements (1), a sinker ring supporting cutting elements (2) positioned at a right angle to said pile elements (1), said cutting elements being resiliently pressed against flanks of said pile elements (1) below their pile forming ledge (1*v*) for forming pile loops (Lc) to be severed, and positioned with sufficient spacing relative to the needles (N), and a cam system cooperating with butts of said needles, said pile elements (1), said cutting elements (2*b*) and said pattern jacks (3*a*, 3*b*), respectively, wherein said pile elements (1) comprise two pile forming ledges (1*u*, 1*v*) arranged adjacently in a longitudinal direction of said pile element for forming pile loops (Lc) to be severed and pile loops (Lu) to remain uncut, said pile forming ledge (1*u*), for forming the pile loops (Lu) to remain uncut, forms the termination of said pile element (1) on a head side, said cam system being designed to select said pile elements (1) for a retracting motion, and said pile forming ledge (1*v*), intended for forming pile loops (Lc) to be severed, is continued at its lower side by a cutting ledge(1*c*).

10. A circular knitting machine according to claim 9, wherein both pile forming ledges (1*u*, 1*v*) each terminate at an end on their head side by stretching or tensioning ledges (1*s*, 1*t*).

11. A circular knitting machine according to claim 10, wherein said upper pile forming ledge (1*u*) is extended to the peak of the pile element (1) with said stretching ledge (1*s*) on the front side of a nib (1*n*) thereof, said nib (1*n*) comprising a downwardly and outwardly inclined lowering ledge (1*l*) facing said dial.

12. A circular knitting machine according to claim 9, wherein said pile forming ledge (1*u*) for uncut pile loops (Lu) is positioned closer to said dial (D) than the pile forming ledge (1*v*) for pile loops (Lc) to be severed.

13. A circular knitting machine according to claim 9, wherein a) subsequent to a selection raising of pattern jacks by raising cams acting on one of the butts (3*a*, 3*b*) thereof for arranging associated pile elements (1) in different positions for the pile forming process, said pattern jacks (3) will remain in this disposition concurrently to the raising of the needles (N) to a clearing position, and also b) arranging all pile elements (1) by cams acting on butts (1*b*) between the needles so that downwardly inclined lowering ledges (1*l*) of said pile elements (1) engage the sinker loops of the previous knitted course and will prevent a movement of the fabric with the needles and additionally will support the take down, and c) retracting the pile elements (1) immediately after clearing of the stitches from the latches of the needles (N) according to their selected disposition from one of adjustable cams acting on the butts (3*a* or 3*b*) of the associated pattern jacks (3) to a stretching position, wherein d) the cam acting on the butt of such a pattern jack (3) which was raised in the previous pile forming process in the lower position for forming uncut pile loops (Lu) will retract the pattern jacks (3) and cooperating pile elements (1) to an extent in which the pile loops (Lu) determined to remain uncut are securely cleared from the pile elements (1), subsequently e) raising the pile elements (1) on their butts (1*b*) actuated by a cam to a cutting position in which the cutting ledges (1*c*) of the pile elements (1) are arranged opposite to the cutting ledges (2*c*) of cutting elements (2) in a sufficient spacing below the "needles (N) such that at least the pile loops (Lc) to be severed of the previous knitted course are not positioned on the cutting ledges (1*c*) of the pile elements (1) so that by the severing movement of the cutting elements (2), controlled by a cam acting on butts (2*b*), exclusively such pile loops (Lc) are severed which were knitted previously to the last course, f) and concurrently with the cutting action performing the reset and re-selection of pattern jacks (3) and also retracting the needles (N) from the clearing position to a feeding position for knitting the succeeding course.

14. A circular knitting machine according to claim 9, wherein cams acting on a butt (3*a*, 3*b*) of said pattern jacks (3) maintain associated pile elements (1) in a constant position during the stitch and pile forming process.

15. A circular knitting machine according to claim 9, wherein concurrently to the stitch and pile forming process cams acting on said pattern jacks (3) retract pile elements (1) associated therewith.

16. A circular knitting machine according to claim 15, wherein said cams are adjustable.

17. A pile element (1) for use in a circular knitting machine comprising two pile forming ledges (1*u*, 1*v*) adjacently arranged in the longitudinal direction of said pile element (1), with each of said pile forming ledges (1*u*, 1*v*) having an end on a head side thereof defined by stretching or tensioning ledges (1*s*, 1*t*).

18. A pile element (1) according to claim 17, wherein a lower pile forming ledge (1*v*) is separated from an upper pile forming ledge (1*u*) by a dividing hook (1*h*), with said stretching ledge (1*t*) formed on a lower side for tensioning pile loops (Lc) drawn out over the lower pile forming ledge (1*v*), and a dividing ledge (1*d*) provided on the upper side of said dividing track for controlling pile loops (Lu) drawn out on the upper pile forming ledge (1*u*) prior to clearance, and a cutting ledge (1*c*) arranged on the stem of said pile element (1) directly below said lower pile forming ledge (1*v*).

19. A pile element (1) according to claim 18, wherein said upper pile forming ledge (1*u*) extends to a peak of said pile element (1) with a stretching ledge (1*s*) on a front side of an arcuate nib (1*n*) at the top of said pile element, said arcuate nib (1*n*) comprising a lowering ledge (1*l*), inclined with respect to a longitudinal axis of said pile element (1), on the opposite side of said pile element.

20. A pile element (1) according to claim 19, wherein said stretching ledge (1*s*) on said nib (1*n*) is arranged at an inclination towards the head side with respect to the longitudinal axis of said pile element (1) with the inclination angle ranging from 20° to 70°.

21. A pile element (1) according to claim 17, wherein said pile forming ledge (1*u*) for uncut pile loops (Lu) and said pile forming ledge (1*v*) for pile loops (Lc) to be severed are positioned at different levels in respect to the widthwise extension of said pile element (1).

22. A pile element as in claim 20 wherein the inclination angle ranges from 30° to 60°.

* * * * *